United States Patent [19]

Inoue

[11] 3,981,576

[45] Sept. 21, 1976

[54] MULTICOLOR ELECTROPHOTOGRAPHIC COPIER WITH LIQUID DEVELOPING

[75] Inventor: Shozo Inoue, Tokyo, Japan

[73] Assignee: Canon Kabushiki Kaisha, Tokyo, Japan

[22] Filed: Apr. 22, 1974

[21] Appl. No.: 463,161

[30] Foreign Application Priority Data

Apr. 24, 1973 Japan ..... 48-46484

[52] U.S. Cl. ..... 355/4; 355/10

[51] Int. Cl.[2] ..... G03G 15/01

[58] Field of Search ..... 355/3 R, 4, 10, 15, 355/17; 427/15–17

[56] References Cited

UNITED STATES PATENTS

| | | | |
|---|---|---|---|
| 3,627,410 | 12/1971 | Jugle | 355/4 |
| 3,661,452 | 5/1972 | Hewes et al. | 355/3 R |
| 3,769,896 | 11/1973 | Samuels et al. | 355/10 X |
| 3,804,512 | 4/1974 | Komori et al. | 355/8 X |
| 3,819,263 | 6/1974 | Draugelis et al. | 355/15 X |
| 3,848,989 | 11/1974 | Yamaji et al. | 355/4 |
| 3,883,349 | 5/1975 | Sato | 355/17 X |

*Primary Examiner*—Joseph F. Peters, Jr.
*Assistant Examiner*—Kenneth C. Hutchison
*Attorney, Agent, or Firm*—Fitzpatrick, Cella, Harper & Scinto

[57] ABSTRACT

In an electrophotographic apparatus wherein the images of successive portions of an original to be copied are formed into electrostatic latent images which in turn are visualized by means of liquid developer to provide a copy image, the latent images are formed in predetermined spaced-apart relationship on the surface of a photosensitive medium and the non-image bearing portions of the photosensitive medium between adjacent ones of the latent images are maintained at a potential of the opposite polarity to that of the developer.

9 Claims, 5 Drawing Figures

MULTICOLOR ELECTROPHOTOGRAPHIC COPIER WITH LIQUID DEVELOPING

BACKGROUND OF THE INVENTION

1. Field of the Invention

This invention relates to an electrophotographic apparatus for visualizing latent images by means of liquid development, and more particularly to an electrophotographic apparatus which prevents image quality from being deteriorated because of contamination by the developing liquid during continuous image formation. The invention is particularly effective for multi-color reproduction.

2. Description of the Prior Art

Electrophotographic apparatus of the image transfer type in which visible images may be formed on a photosensitive medium and transferred to ordinary paper to provide copies thereof has become widely popular because of its operating cost. Such apparatus, when used with liquid developer, can provide good half-tone reproduction and has been in great use for such purpose.

On the other hand, for the purpose of multi-color reproduction, there is a method known whereby color-resolved images of an original to be copied are applied to a photosensitive medium and each of these color-resolved images is individually reproduced and superposed one upon another to thereby provide a final multi-color reproduction. Particularly in a multi-color copying apparatus which may produce multi-color copies through an image transfer to ordinary paper or like medium, it is preferred and widely practised that a single photosensitive medium be exposed to image lights of different colors through a single optical system in order to ensure proper registration between different color images of the original as they are superposed one upon another. The apparatus of such type suffers from the problem that the necessity for different color developments to be effected successively on a single photosensitive medium tends to cause mixture of the different colors during development, and this is particularly so in the case of liquid development. More specifically, in the case of liquid development, after one color development has been completed, some of the developing liquid remains deposited on the photosensitive medium even if that particular color developing means ceases to operate and with the movement of the photosensitive medium, such deposited developing liquid flows along the surface of the photosensitive medium to mix with a developing liquid from a subsequent color developing device when another color development occurs, thus causing mixture of colors.

Such mixture might affect the toner density in the subsequent steps even in the case of single color development. This must be avoided to secure high quality of images.

SUMMARY OF THE INVENTION

It is an object of the present invention to provide an apparatus which eliminates the above-noted disadvantages. More particularly, it is an object of the present invention to provide an electrophotographic copying apparatus of the liquid development type which eliminates deterioration of resultant image quality due to contamination of the liquid.

It is another object of the present invention to provide an electrophotographic copying apparatus which, in case of multi-color development, may produce clear multi-color images without causing mixture of colors.

Generally describing the apparatus of the present invention, when latent images of an original are to be formed on a photosensitive medium and visualized by means of liquid developers, the latent images are successively formed in predetermined spaced-apart relationship on the surface of the photosensitive medium and the non-image bearing portions defined by those predetermined spaces are maintained at a potential of the opposite polarity to that of the developer.

Further, the apparatus of the present invention effective for multi-color development is featured in that latent images of an original are continuously formed on an endlessly moving photosensitive medium and such latent images are successively visualized by liquid developers of different colors while non-image bearing portions of the photosensitive medium between adjacent ones of the continuously formed latent images provide areas of high potential of the opposite polarity to that of the developers.

The invention will become more fully apparent from the following detailed description thereof taken in conjunction with the accompanying drawings.

DESCRIPTION OF THE PREFERRED EMBODIMENTS

Figure 1:
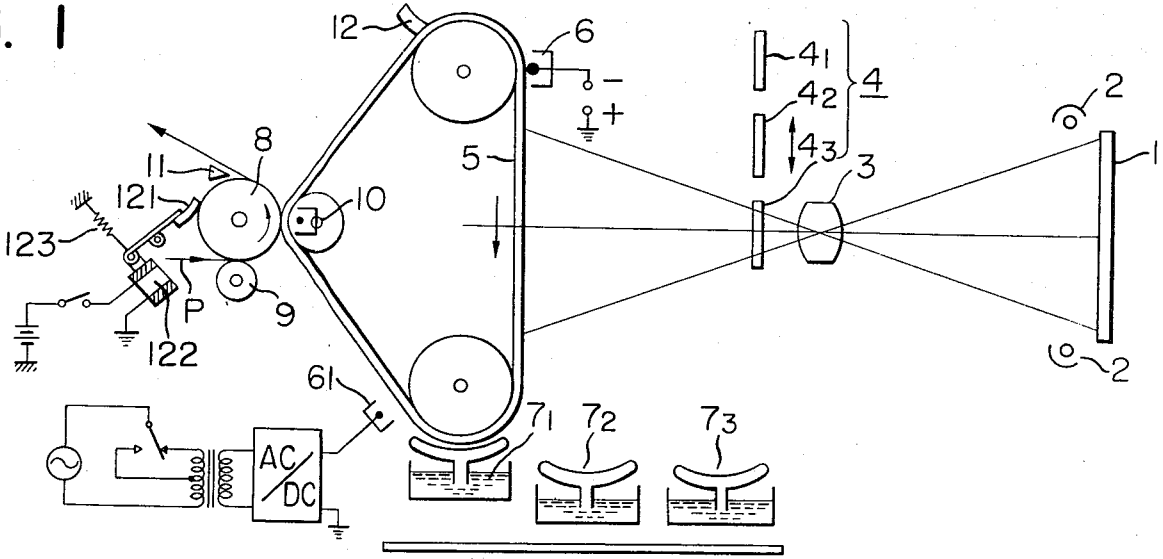
FIG. 1 is a schematic illustration of the apparatus according to an embodiment of the present invention.

Referring to FIG. 1, it schematically illustrates electrophotographic copying apparatus according to the present invention as applied to the Carlson system. An original to be copied is held on an original carriage 1 and illuminated by illuminating means 2, 2 and projected through an optical system 3 onto a photosensitive medium 5 to form an image thereon. When this occurs, the original image is color-resolved or density-adjusted by color resolving means 4 to form the image. On the other hand, the photosensitive medium 5 has the surface thereof precharged by a charger 6. As is well-known, the polarity of this charge is negative (−) when the photosensitive medium 5 has a photosensitive layer (of Se, ZnO or like material) over a conductive substrate.

Thereafter, the photosensitive medium 5 so exposed to the image light is developed by a developing unit, such as $7_1$, with developing means 7 having a predetermined color developer, to thereby visualize the latent image formed on the surface of the photosensitive medium. Any excess of the developing liquid deposited on the photosensitive medium is removed therefrom by a post-charger 61 so that the amount of the developing liquid may be controlled to an optimum for image transfer to be effected. On the other hand, toner particles in the liquid are sufficiently attracted to the photosensitive medium to eliminate any disturbance of the formed image which would otherwise result from movement of the toner particles, thus enabling a clear image transfer to occur. Immediately after the development of the image bearing surface portion, the developing unit ceases operating, but it may undergo a mechanical or physical delay which would cause even the non-image bearing surface portion to be developed to some extent. Since, however, the non-image bearing surface portion is maintained at a sufficient potential, the toner in the developing liquid is fully attracted to the non-image bearing surface, and does not effect subsequent images. Also, if the voltage in the non-image bearing surface portion is changed by increasing the voltage of the post-charge, the part of the developing liquid which flows down from the non-image bearing surface portion will be fully removed to provide a better effect as well as to ensure more secure deposition of the toner particles, which eliminates the possibility of the excess developing liquid flowing into the subsequent image developing process. Thus, a quite satisfactory image reproduction may be accomplished without causing any variation to the density of the developing liquid during the subsequent process.

Thereafter, the visible image is transferred onto a transfer medium P. When this occurs, the transfer medium P is urged against a transfer roller 8 by an urge roller 9, whereafter the photosensitive medium 5 and the transfer roller 8 are urged. At this time, a transfer charger 10, for example, may be used, also. The transfer medium P with the image so transferred thereto is separated from the transfer roller 8 by a separator pawl 11 or the like, thus providing a copy of the original image. In multi-copy reproduction, it will be apparent that the separation of the transfer medium occurs after a particular color image has been transferred.

If, in such superposition image transfer, the transfer roller holding the transfer medium is designed such that it is urged against the photosensitive medium in an image bearing portion thereof to transfer the image to the transfer medium but it is separated from the photosensitive medium in a non-image bearing portion thereof and again urged against the photosensitive medium in a subsequent image bearing portion thereof, the toner deposited on the non-image bearing portions will not affect the transfer medium.

If the peripheral length of the transfer roller is the sum of the length of the image bearing portions formed on the photosensitive medium and the length of the succeeding non-image bearing portions which each are of predetermined dimensions, there will not be required the above-described urge-and-separation mechanism for the transfer roller itself. In this case, means such as a cleaning blade or the like may preferably be provided to clean the roller surface after image transfer. The embodiment shown in FIG. 1 is arranged such that during image transfer operation the cleaning blade 121 is maintained in its inoperative condition as by a solenoid 122 and after completion of an image transfer, the solenoid is deenergized to permit the cleaning blade to be urged against the transfer roller by the force of a spring 123.

Effectively, the length of the transfer medium may be substantially equal to the peripheral length of the described transfer roller. By doing this, the burden of cleaning the surface of the photosensitive medium or of the transfer roller may be greatly reduced because the toner on the non-image bearing portions of the photosensitive medium is transferred to the transfer medium. Moreover, after the separation of the transfer medium from the transfer roller, the non-image bearing portion of the transfer medium may be cut off so that the final copy may be damaged in no way.

On the other hand, the photosensitive medium 5 may have any residual developer on the surface thereof removed by cleaning means 12 in preparation for reuse.

Figure 2:
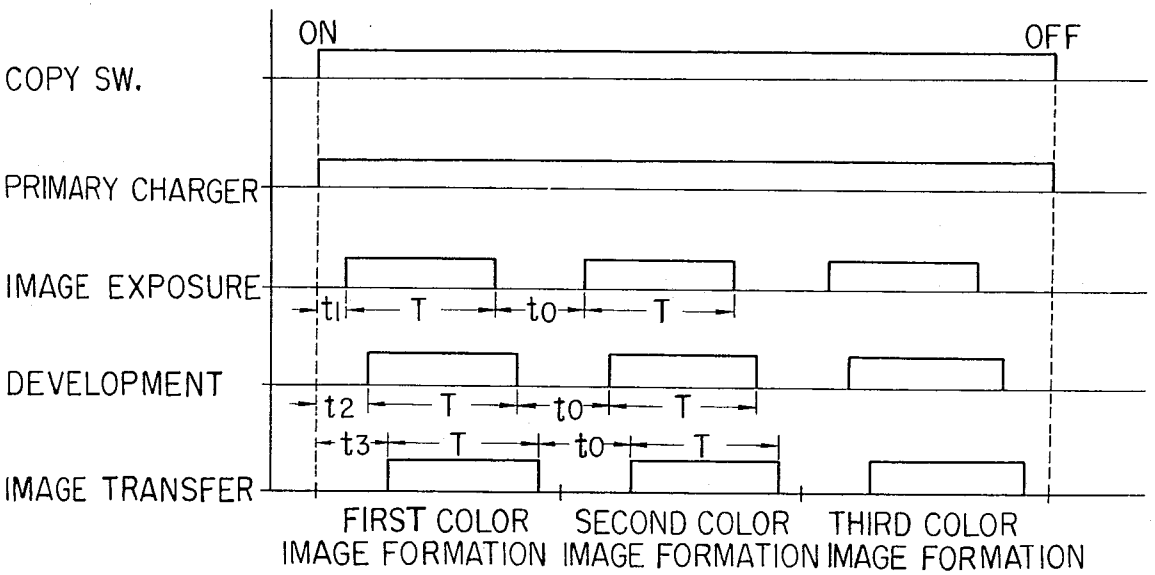
FIG. 2 illustrates the operation of the apparatus shown in FIG. 1.

Referring now to FIG. 2, it shows the time sequence for illustrating the operations of the various means in the multi-color image reproduction effected by the apparatus of FIG. 1. Closing of a copy switch (not shown) causes the various means of the apparatus to initiate their operations in accordance with a predetermined time sequence. First, the negative charger 6 is normally operated to negatively charge the surface of the photosensitive medium. The application of the image light occurs with a time lag $t_1$. For example, when yellow development is to be effected, the image light is applied through a red filter of the color resolving means 4 and focused on the photosensitive medium. When the portion of the photosensitive medium on which a latent image has been formed reaches the developing station, the developing means 7 has already initiated its operation with a time lag $t_2$. At this time, development may be effected by means of yellow developer in accordance with the image light passed through the red filter. When liquid development is carried out in such a manner, it has been the case with the prior art apparatus that, even if only a first latent image bearing portion is developed, the developing liquid deposited on the surface of the photosensitive medium is displaced in the direction of gravity against the movement of the photosensitive medium. At a later time, when image light passed through a green filter, for example, is visualized at the developing station, development should necessarily be effected by means of magenta developer, whereas, in fact, the development is effected by means of the previously used yellow developer remaining on the photosensitive medium before the second development. The result is that the second latent image is developed by means of a mixture of yellow and magenta. In contrast, according to the apparatus of the present invention, negative charging occurs during application of each image light, and during the times $t_0$ or $t_1$ thereby maintaining the surface of the photosensitive medium at the opposite polarity to that of the developing toner. Such construction leads to a result that, even if the development of the exposed portion by means of the first or yellow developer has been completed and the developing means stopped from operating, the yellow developer remaining on the photosensitive medium has the yellow toner therein consumed due to a developing effect acting like the high potential portion across the latent image. When the second latent image portion has come to the developing station there may remain some liquid (dispersed liquid) itself, but such liquid no longer contains any toner therein, thus preventing the two colors from mixing together during the second development effected by means of magenta developing liquid. Therefore, even when time $t_0$ has passed after the development of the first color image and the developing unit has been operated for the second color development, no mixture of the colors will occur and the image transfer started by the transfer means with a time lag $t_3$ can always provide a clear color copy. In such image transfer process, it will be apparent that where the multi-color reproduction employs two or more colors, the transfer medium P is not separated from the transfer roller until a predetermined number of image transfers have been completed.

Figure 3:
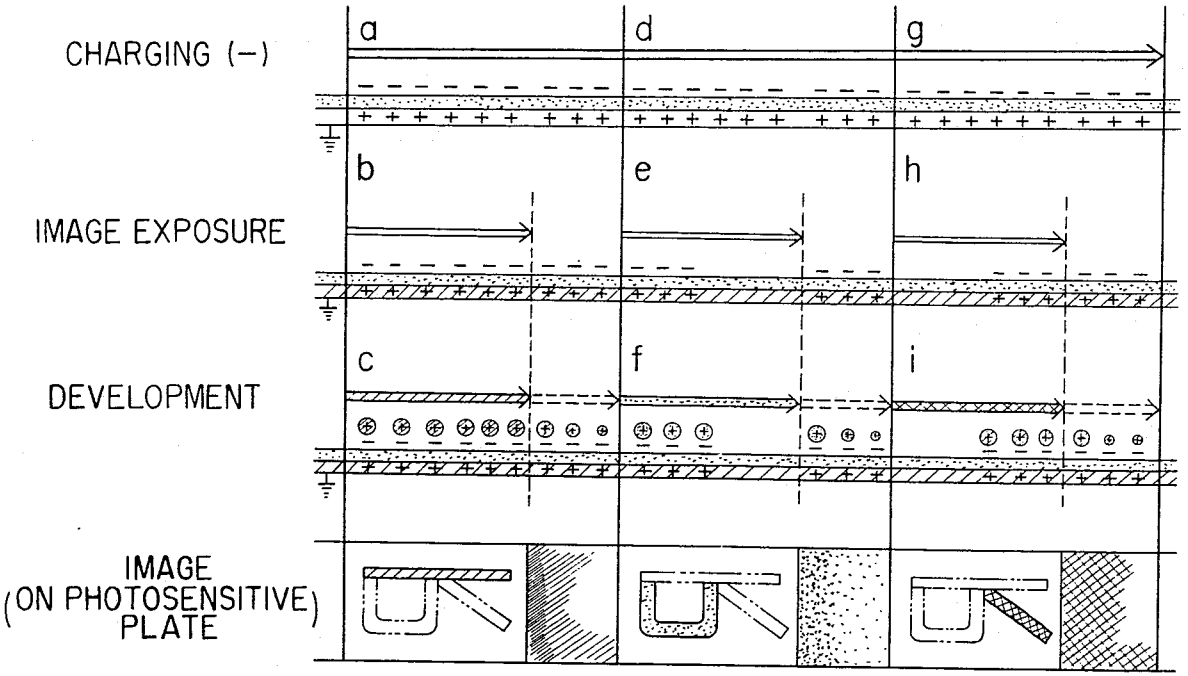
FIG. 3 schematically illustrates the charge and formed images on the surface of a photosensitive medium in the apparatus of FIG. 1.

FIG. 3 schematically illustrates the charged conditions in the surface of the photosensitive medium during each of the steps described above in connection with the time sequence of FIG. 2, and also the manner in which images are formed.

In the step *a*, the surface of the photosensitive medium is negatively charged to induce a charge in the electrically conductive substrate. In the step *b*, exposure to image light occurs to nullify the charge in the light area of the exposed portion of the photosensitive medium. On the other hand, the rest of the photosensitive medium remains charged and in the step *c*, the exposed portion is developed and the formed image is visualized by positively charged toner, but it may be possible in this case that the residual developing liquid flows to the unexposed portion of the photosensitive medium. Since, however, the non-image bearing portion still remains charged, such portion attracts the toner contained in the developing liquid, thus avoiding any adverse effect on the development during the subsequent step *d* and the succeeding steps. In addition, the adverse effect on the liquid itself may be substantially eliminated if the post-charge is effected in the manner as previously described. From the step *d* onward, the same process as described above is repeated but with different colors used.

Figure 4:
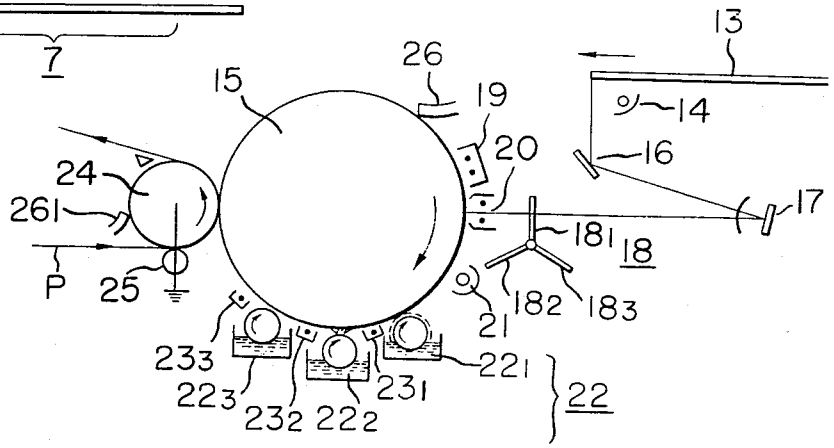
FIG. 4 is a schematic illustration of the apparatus according to another embodiment of the present invention.
Figure 5:
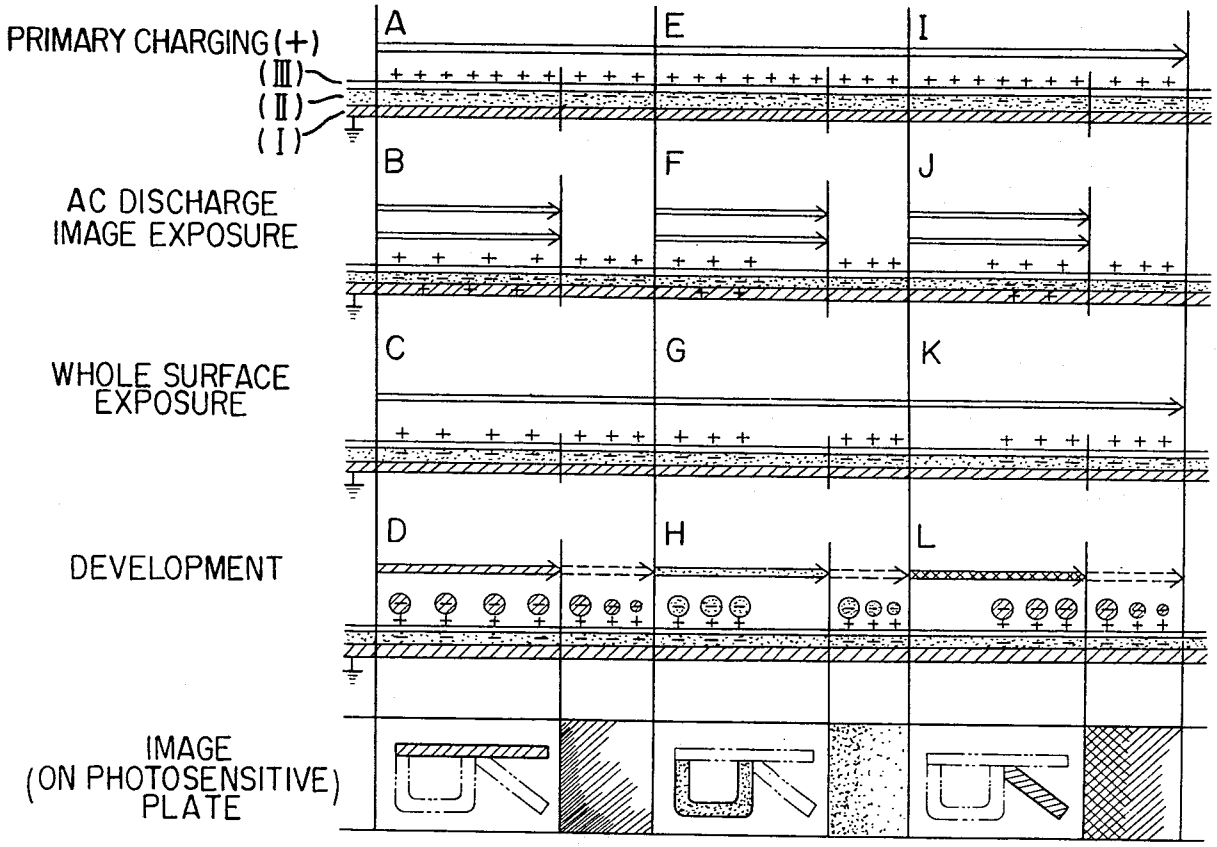
FIG. 5 schematically illustrates the charge and formed images on the surface of a photosensitive medium in the apparatus of FIG. 4.

Although the present invention has been illustrated with respect to an embodiment utilizing the abovementioned Carlson process, FIG. 4 illustrates another embodiment of the present invention with respect to an apparatus utilizing an electrophotographic process which uses a photosensitive medium having an outermost dielectric layer. An original to be copied is placed on an original carriage 13 and illuminated by illuminating means 14 and projected via mirro 16, in-mirror lens 17, etc. onto a photosensitive drum 15 to form an image thereon. Disposed in such optical path is color resolving means 18 including various resolving filters $18_1$, $18_2$ and so on alternately arranged at predetermined positions. The photosensitive medium 15 is of the type in which a dielectric layer covers a photosensitive layer of CdS or Se overlaid on an electrically conductive substrate. First, the surface of this photosensitive drum 15 is charged by a primary charger 19. This charge may be positive (+) if the photoconductive layer is formed of CdS, and negative (−) if the photoconductive layer is formed of Se. Subsequently, application of image light is effected through the filter $18_1$. Simultaneously therewith, an AC discharger 20 effects discharging. This AC discharger 20 is operated only during application of image light and not during non-exposure time. Alternatively, the discharger 20 may be maintained in complete dark during the non-exposure time. Thus, the unexposed portion retains its surface charge. Thereafter, an overall exposure light source 21 effects overall exposure. As a result, a contrast of potential is provided in the image bearing portion formed by being exposed to image light and thus, the formed image becomes a latent image which can be visualized. Such latent image is visualized in developing means 22 and by means of a color developer corresponding to the filter $18_1$. Any developing liquid is squeezed out by a postcharger 23. Moreover, the developer flowing down from the image forming portion has the toner therein fully attracted in the non-image forming portion, thus affecting the subsequent color development in no way. Thereafter, the visualized image is transferred to a transfer medium P, whereafter the surface of the photosensitive drum 15 is cleaned by cleaning means 26. Steps similar to those described above are repeated to form a second color image. FIG. 5 schematically illustrates the charged conditions of the photosensitive medium surface and the image formation thereon in the apparatus described just above.

The photosensitive medium, as mentioned above, comprises an electrically conductive substrate I covered with a layer II of photoconductive material such as Se or CdS. which in turn is covered with a dielectric layer III. This photoconductive layer is of such a characteristic that it readily permits introduction of positive charge thereinto when if is of the P-type and introduction of negative charge thereinto when it is of the N-type. FIG. 5 shows a case where the N-type photoconductive layer is employed. First, step A occurs during which the dielectric layer III of the photosensitive medium is positively charged by the primary charger. This charge causes negative charge to be introduced from the conductive substrate I into the photoconductive material layer II. In the step B, the image forming portion is subjected to image light and AC discharge simultaneously, so that there is produced a variation in the density of the surface charge. On the other hand, the non-image forming portion is kept from the AC discharge and thus retains its surface charge. In the step C, the surface of the photosensitive medium is subjected to overall exposure so that a potential contrast is provided in the image forming portion, thus providing a latent image of high contrast. Thereafter, in the step D, the image forming portion is developed by means of a developer containing negatively charged toner. In the meantime, some of residual developer tends to flow down toward the next image forming portion, but the toner in such developer is attracted to the non-image forming portion and does not disturb the image tone to be subsequently provided, as has been noted above. Then, similar processes E, F, G, H and I, J, K, L are repeated for the formation of other color images.

As has particularly been described above, the apparatus of the present invention creates non-image forming portions of high potential and opposite in polarity to the toner, thereby completely preventing the developing liquid used for a first image forming portion from affecting a subsequent image forming portion. With such a construction, it is possible to provide clear color reproduction without mixture of colors occurring even in multi-color reproduction. Further, control of the various parts of the present apparatus can very advantageously be realized by adding control mechanisms to the control system of the prior art apparatus.

I claim:

1. An electrophotographic copying apparatus comprising:

a rotatable image bearing member;

means for successively forming on said image bearing member electrostatic latent images of respective color components of an original in a predetermined spaced-apart relationship, thereby defining non-image bearing portions on said image bearing member between said successive images;

means for maintaining said non-image bearing portions of said image bearing member at a potential of a predetermined polarity;

developing means for applying different color charged developers to said image bearing member, said charged developers having a polarity opposite to said predetermined polarity, and each said developer comprising toner particles suspended in developing liquid, said developer means including a plurality of developing units, one for each said different color developer, disposed below said image bearing member for applying the developers individually to the respective latent images, wherein excess toner particles are attracted to said non-image bearing portions thereby avoiding mixing of the developers;

means for transferring the images thus developed onto a transfer material in a superimposed relationship; and means for cleaning said image bearing member after transfer of the images.

2. An electrophotographic copying apparatus comprising:

a photosensitive medium movable in an endless manner:

means for uniformly charging said photosensitive medium;

means for exposing said photosensitive medium to image light having separate color components of an original to form separate latent images on an image bearing surface of said photosensitive medium at predetermined spaced intervals;

means for maintaining non-image bearing portions of said member at a potential of predetermined polarity;

developing means for supplying charged different color developers to said photosensitive medium, said developers being charged to a polarity opposite to said predetermined polarity and each said developer comprising toner particles suspended in developing liquid, said developer means including a plurality of developing units, one for each said different color developer, disposed below the image bearing surface of said photosensitive medium for applying the developers individually to the respective latent images, wherein excess toner particles are attracted to said non-image bearing portions thereby avoiding mixing of the developers;

means for actuating said respective developing units when an image bearing portion of said photosensitive medium becomes aligned therewith, and for deactuating said respective developing units when a non-image bearing portion of said photosensitive medium becomes aligned therewith;

post charger means for imparting a liquid squeezing charge to the surface of said photosensitive medium after development;

means for transferring developed images to a transfer member in a superimposed relationship; and means for cleaning said image bearing member after transfer of the images.

3. An electrophotographic copying apparatus according to claim 2, wherein the voltage applied by said postcharger means is such that a higher potential is provided in the non-image bearing portions than in the image bearing portions of said photosensitive medium.

4. An electrophotographic copying apparatus according to claim 2, wherein each of said developing units of said developing means is disposed along the path of movement of said photosensitive medium, and said post-charger means is provided adjacent said developing units in the downstream direction of movement of said photosensitive medium.

5. An electrophotographic copying apparatus according to claim 2, wherein said means for transferring developed images comprises a rotatable roller and has a cleaning mechanism capable of bearing against the surface of said roller.

6. An electrophotographic copying apparatus comprising:

a photosensitive medium movable in an endless manner and having at least a dielectric layer over the surface of a photoconductive layer;

means for projecting image light having color components of an original in a predetermined relationship on the surface of said photosensitive medium to focus and form separate spaced-apart images thereon, thereby defining non-image bearing portions between said separate images;

optically opened voltage application means for applying a potential only to the image forming portions of said photosensitive medium, said application means being disposed adjacent said photosensitive medium and located proximate the image focused position;

means for maintaining said non-image bearing portions of said medium at a potential of predetermined polarity;

liquid developing means including a plurality of developing units positioned beneath said photosensitive medium for supplying liquid developers having different color toners, said developers being charged to a polarity opposite to said predetermined polarity;

post charger means for imparting a liquid squeezing charge to the surface of said photosensitive medium after development;

and means for transferring said developed images onto a transfer medium for carrying a visible image thereon.

7. An electrophotographic copying apparatus according to claim 6, wherein the voltage applied by said post-charger means is such that a higher potential is provided in the non-image bearing portions than in the image bearing portions of said photosensitive medium.

8. An electrophotographic copying apparatus according to claim 6, wherein each of said developing units of said developing means is disposed along the path of movement of said photosensitive medium, and post-charger means is provided downstream of said developing units.

9. An electrophotographic copying apparatus a according to claim 6, wherein said means for transferring said images comprising a rotatable roller and has a cleaning mechanism capable of bearing against the surface of said roller.

* * * * *